US009469129B2

(12) United States Patent
Suzuki

(10) Patent No.: US 9,469,129 B2
(45) Date of Patent: Oct. 18, 2016

(54) PRINTING METHOD AND APPARATUS FOR PERFORMING CONVEYANCE CONTROL USING MARKS IN NON-IMAGE AREAS

(71) Applicant: CANON KABUSHIKI KAISHA, Tokyo (JP)

(72) Inventor: Seiji Suzuki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/250,667

(22) Filed: Apr. 11, 2014

(65) Prior Publication Data

US 2014/0306395 A1 Oct. 16, 2014

(30) Foreign Application Priority Data

Apr. 16, 2013 (JP) ..... 2013-085958

(51) Int. Cl.

| | |
|---|---|
| ***B41J 11/46*** | (2006.01) |
| ***B41J 3/60*** | (2006.01) |
| ***B41J 15/00*** | (2006.01) |
| ***B65H 35/04*** | (2006.01) |
| ***B41J 29/38*** | (2006.01) |
| ***B41J 11/66*** | (2006.01) |
| ***B26D 5/32*** | (2006.01) |
| ***B26D 1/01*** | (2006.01) |
| ***B26D 5/34*** | (2006.01) |

(52) U.S. Cl.

CPC ..... *B41J 11/46* (2013.01); *B26D 1/015* (2013.01); *B26D 5/32* (2013.01); *B26D 5/34* (2013.01); *B41J 3/60* (2013.01); *B41J 11/663* (2013.01); *B41J 15/00* (2013.01); *B41J 29/38* (2013.01); *B65H 35/04* (2013.01); *B65H 2301/5111* (2013.01); *B65H 2511/512* (2013.01); *B65H 2801/15* (2013.01)

(58) Field of Classification Search

CPC ..... B41J 11/42; B41J 11/46; B41J 3/60

See application file for complete search history.

(56) References Cited

U.S. PATENT DOCUMENTS 5,992,973 A * 11/1999 Wen ..... 347/43
2005/0259141 A1* 11/2005 Kim et al. ..... 347/197

(Continued)

FOREIGN PATENT DOCUMENTS

JP 11268358 A * 10/1999 ..... B41J 11/42
JP 2002216171 A * 8/2002 ..... G07B 3/02

(Continued)

OTHER PUBLICATIONS

Shigeru Toriihara, Masahito Yoshida, Masahiro Sugimoto, Seiji Suzuki, U.S. Appl. No. 14/250,660, filed Apr. 11, 2014.

*Primary Examiner* — Daniel J Colilla
(74) *Attorney, Agent, or Firm* — Fitzpatrick, Cella, Harper & Scinto

(57) ABSTRACT

Both highly reliable detection of a mark and suppression of a sheet consumption amount can be achieved when a continuous sheet is cut on an image basis after a plurality of images has been printed on the continuous sheet. For this purpose, at the time of a first surface printing operation, by accumulating correction factors obtained for a plurality of pages, a more highly reliable correction factor is obtained. Further, at the time of a second surface printing operation, by controlling a conveyance operation with the highly reliable correction factor, a cut mark is surely detected by the detecting operation of the cut mark sensor within a limited range.

7 Claims, 9 Drawing Sheets

(56) References Cited

U.S. PATENT DOCUMENTS

| | | | | |
|---|---|---|---|---|
| 2011/0310151 | A1* | 12/2011 | Serizawa | B41J 11/0095 347/14 |
| 2012/0020689 | A1* | 1/2012 | Inoue et al. | 399/68 |
| 2012/0050438 | A1* | 3/2012 | Wada | 347/104 |
| 2012/0081715 | A1* | 4/2012 | Takano | 358/1.5 |
| 2012/0194597 | A1 | 8/2012 | Okamoto et al. | |
| 2013/0029825 | A1* | 1/2013 | Rich | 493/324 |
| 2014/0002531 | A1* | 1/2014 | Mo | B41J 11/46 347/16 |
| 2014/0049575 | A1* | 2/2014 | Leighton et al. | 347/14 |

FOREIGN PATENT DOCUMENTS

| | | | | |
|---|---|---|---|---|
| JP | 2003063072 | A * | 3/2003 | B41J 3/42 |
| JP | 2012-158122 | A | 8/2012 | |

* cited by examiner

PRINTING METHOD AND APPARATUS FOR PERFORMING CONVEYANCE CONTROL USING MARKS IN NON-IMAGE AREAS

BACKGROUND OF THE INVENTION

1. Field of the Invention

The present invention relates to a duplex printing apparatus and duplex printing method that print pluralities of images on both surfaces of a continuous sheet.

2. Description of the Related Art

There has been provided a printing apparatus that sequentially prints a plurality of images on a continuous sheet, and cuts the sheet on an image (page) basis. In such a printing apparatus, a conveyance state of the continuous sheet is influenced by an individual difference of the printing apparatus, the type or width of the sheet, use environment, or the like, and therefore a conveyance distance of the continuous sheet per unit time includes a certain level of error For this reason, in order to prevent the continuous sheet from being cut in the middle of an image, a method that, between images, provides a non-image area printed with a cut mark indicating a cutting position, and on the basis of timing when a detector detects the cut mark, cuts the continuous sheet with a cutter is used.

However, in the case where in order to detect such a cut mark, the detector performs a reading operation throughout the continuous sheet, a pattern in an image, which is similar to the cut mark, may also be determined as the cut mark to cut the continuous sheet in the middle of the image.

To address such a problem, Japanese Patent Laid-Open No. 2012-158122 discloses a method that performs a reading operation by a detector only on the vicinity of a non-image area, which is printed with a cut mark. Also, Japanese Patent Laid-Open No. 2012-158122 discloses a configuration in which by focusing on the fact that an error in conveyance amount of a continuous sheet is increased along with an increase in conveyance distance of the continuous sheet, i.e., an increase in size of an image, a size of a non-image area between two successive images and a reading area by the detector are adjusted depending on a size of a precedent image. According to such Japanese Patent Laid-Open No. 2012-158122, in a non-image area having a size enough to include a conveyance error of the continuous sheet, a cut mark can be detected, and therefore even in the case where a conveyance error occurs, the continuous sheet can be cut in a correct position.

SUMMARY OF THE INVENTION

An object of the present invention is to, when a plurality of images are printed on the continuous sheet serially, achieve an information regarding conveyance of the sheet by a new method.

In a first aspect of the present invention, there is provided a printing method comprising: printing so as to alternately arrange an image area and a non-image area on a continuous sheet in conveyance; forming marks in the non-image areas; detecting the marks; obtaining information associated with a conveyance error at a time of conveying the continuous sheet based on a measured conveyance amount and a theoretical conveyance amount until the each of the marks is detected; and performing conveyance control of the continuous sheet in the printing thereafter with use of the information obtained.

In a second aspect of the present invention, there is provided an information obtaining method for conveying sheet comprising: printing so as to alternately arrange an image area and a non-image area on a continuous sheet in conveyance and forming marks in the non-image areas; detecting the marks, and obtaining information associated with a conveyance error at a time of conveying the continuous sheet based on a measured conveyance amount and a theoretical conveyance amount until the each of the marks is detected.

In a third aspect of the present invention, there is provided a printing apparatus comprising: a conveying unit configured to convey a continuous sheet; a printing unit configured to print so as to alternately arrange an image area and a non-image area on the continuous sheet in conveyance and form marks in the non-image areas; a detecting unit configured to detect the marks, and a obtaining unit configured to obtain information associated with a conveyance error at a time of conveying the continuous sheet based on a measured conveyance amount and a theoretical conveyance amount until the each of the marks is detected.

Further features of the present invention will become apparent from the following description of exemplary embodiments (with reference to the attached drawings).

DESCRIPTION OF THE EMBODIMENTS

Figure 1:
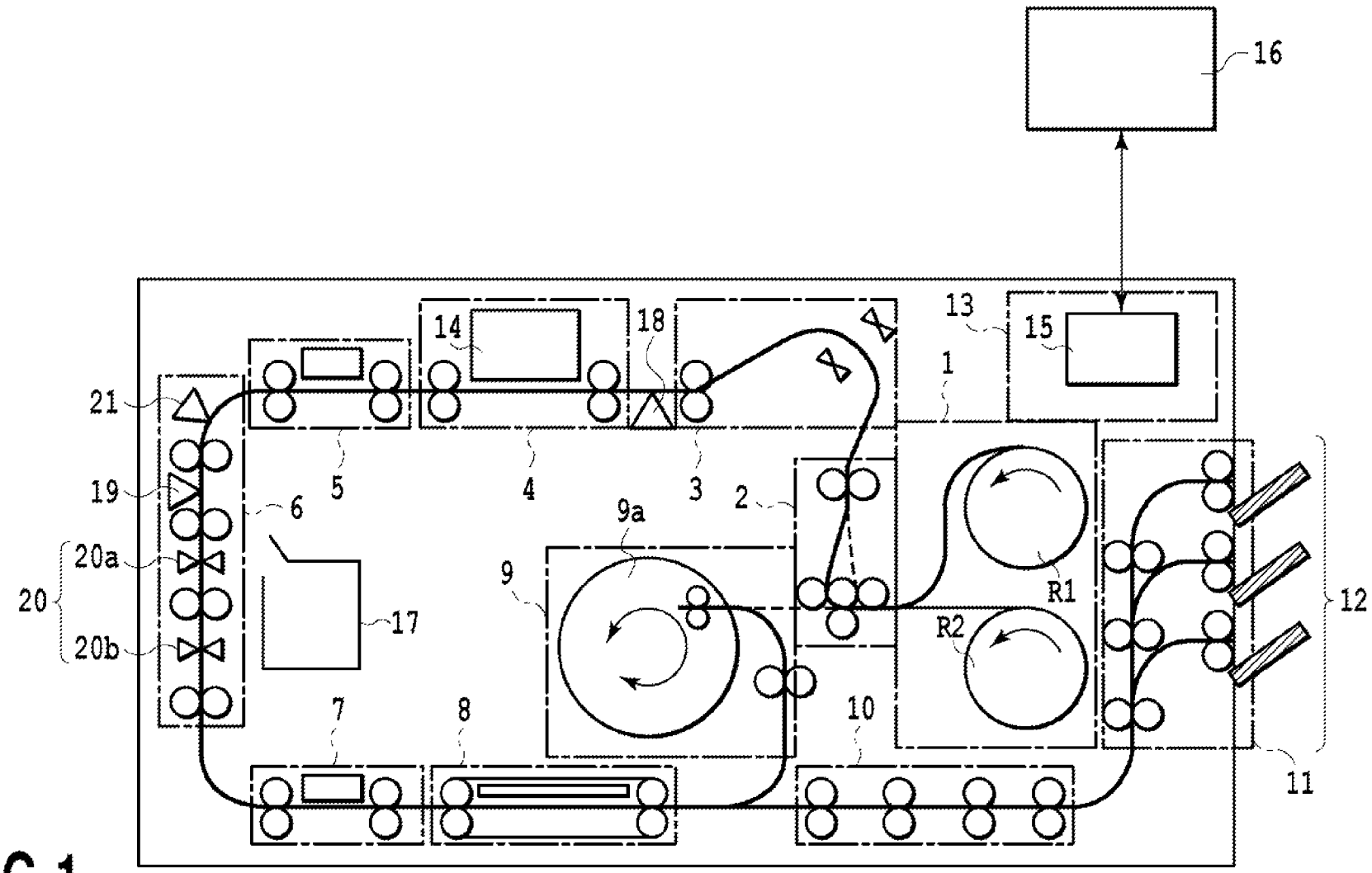
FIG. 1 is a cross-sectional view of a duplex printing apparatus usable in the present invention.

FIG. 1 is a cross-sectional view of a duplex printing apparatus usable in the present invention. A sheet feeding unit 1 contains two rolls R1 and R2, and alternatively draws a sheet to feed the sheet to a conveyance path. Note that the number of containable rolls is not limited to two, but may be one, or three or more.

A decurling unit 2 is a unit that reduces a degree of a curl (curve) of a sheet fed from the sheet feeding unit 1 or an after-mentioned reversing unit 9. In the decurling unit 2, two pinch rollers are pressed against one driving roller to give the sheet a curve having a direction opposite to a direction of the curl. The sheet passes through the decurling unit 2, whereby the degree of the curl given by the sheet feeding unit 1 or the reversing unit 9 is reduced, and the sheet is smoothly conveyed.

A skewing correcting unit 3 is a unit that corrects skewing (an inclination with respect to a traveling direction) of the sheet having passed through the decurling unit 2. By pressing a sheet end part on a side serving as a reference against a guide member, the sheet is directed so as to travel straight.

A mark reader 18 is a unit that, at the time of performing duplex printing, optically reads a reference mark on a first surface already printed with an image. The mark reader 18 has a light source (e.g., a white LED) that illuminates a sheet surface; and a light receiver that detects light from the illuminated sheet surface on an RGB component basis, such as a photodiode or an image sensor. In the case of performing duplex printing, in an after-mentioned printing unit 4, a printing position of an image on a second surface is adjusted according to the reference mark on the first surface, which has been read by the mark reader 18.

In the printing unit 4, ink is ejected from a print head 14 onto a sheet in conveyance to print an image. The print head 14 also prints, in addition to image data received from a host device 16, a cut mark indicating a position to cut the sheet, the above-described reference mark, a test pattern for checking a print state of the print head, and the like. The printing unit 4 is provided with a plurality of conveyance rollers for conveying the sheet, a platen that supports the sheet from below, and the like, and supports the sheet so as to smooth an area of the sheet, which faces to the print head 14.

The print head 14 of the present embodiment includes an inkjet type line head in which a plurality of nozzles ejecting ink are arrayed in a direction intersecting with a sheet conveyance direction within a range covering a maximum width of a sheet supposed to be used. Further, a plurality of such line heads are parallel arranged in the conveyance direction up to the number corresponding to the number of ink colors. In the present embodiment, it is assumed that seven line heads corresponding to seven colors of C (cyan), M (magenta), Y (yellow), LC (light cyan), LM (light magenta), G (gray), and K (black) are provided. Inks of the respective colors are supplied to the print head 14 through ink tubes from unillustrated ink tanks.

An inspecting unit 5 is a unit that is provided with a CCD image sensor or a CMOS image sensor, and optically reads an inspection pattern or image on a sheet printed in the printing unit 4. Information having been read is transferred to a control unit 13, where nozzle states of the print head 14, a sheet conveyance state, a position of an image, and the like are assessed.

A cutter unit 6 is provided with: an edge sensor 21 for detecting a sheet fore end; a cut mark sensor 19 that optically detects a cut mark on a sheet; and a cutter 20 that cuts the sheet on the basis of a location of the cut mark detected by the cut mark sensor 19. The cutter 20 includes a cutter 20*a* arranged on an upstream side and a cutter 20*b* arranged on a downstream side, which respectively cut fore and rear end sides of an image according to the cut mark printed on the sheet. A cut sheet after the cutting, i.e., an image sheet (page), is conveyed to the next step by a plurality of conveyance rollers. On the other hand, a non-image sheet between images is contained in a trash box 17. As described, the cutter unit 6 is provided with a mechanism for classifying a conveyance path between an image sheet and a non-image sheet after cutting. Note that in the case of performing duplex printing, the cutter unit 6 only cuts a rear end part of a last image on a first surface, and a continuous sheet is conveyed to an information printing unit 7 without being cut. Cutting control in the cutter unit 6 will be described later in detail.

The information printing unit 7 prints pieces of information such as a serial number, date, and the like related to printing as characters and codes in a margin area of an image sheet.

A drying unit 8 is a unit for drying given ink for a short period of time, and dries the ink by applying hot air to a passing image sheet from a rear surface that is on a side opposite to a printed surface. A drying method is not limited to the hot air method, but may be a method that irradiates a sheet surface with an electromagnetic wave (such as ultraviolet or infrared light).

In the present embodiment, a path from the above-described sheet feeding unit 1 to drying unit 8 is referred to as a first path. The first path is of a U-turn shape from the printing unit 4 to the drying unit 8, and the cutter unit 6 is located approximately in the middle of the U-turn shape. The first path is a path through which, regardless whether printing is duplex printing or simplex printing, a sheet passes in common. A continuous sheet having been subjected to first surface printing of the duplex printing is, after the first path, conveyed to a second path provided with the reversing unit 9. On the other hand, a cut sheet having been subjected to second surface printing of the duplex printing, or a cut sheet having been subjected to the simplex printing is, after the first path, conveyed to a third path provided with a discharging/conveying unit 10.

The reversing unit 9 is a unit that, in the case of performing duplex printing, temporarily rewinds a continuous sheet having been subjected to first surface printing. The continuous sheet having been subjected to the first surface printing is gradually rewound by a rotary body (drum) 9*a* that rotates anticlockwise. The rotary body 9*a* stops when having rewound the continuous sheet to a rear end part of the continuous sheet, and then rotates in an opposite direction, i.e., clockwise. This causes the continuous sheet to be sent out to the decurling unit 2. The decurling unit 2 corrects the sheet so as to reduce a degree of a curve provided at the time of the rewinding by the rotary body 9*a*.

In a path from the decurling unit 2 toward the printing unit 4, the continuous sheet is in a state of being reversed in terms of front and back surfaces and fore and rear ends thereof. That is, the continuous sheet is conveyed with a second surface facing to the print head 14 and the rear end part at the time of the first surface printing serving as the fore end part. A path through which the sheet sent out of the drying unit 8 is reversed in terms of the front and back surfaces thereof and then sent into the decurling unit 2 as described is referred to as the second path.

The discharging/conveying unit 10 conveys a cut sheet, which was cut in the cutter unit 6 and dried in the drying unit 8, to a sorter unit 11. The sorter unit 11 sorts printed cut sheets on a group basis such as on a size basis, and discharges the cut sheets to corresponding discharge ports. For each of the discharge ports, a tray 12 for receiving cut sheets is prepared, and a cut sheet is placed on any of the trays 12. A path through which a sheet sent out of the drying unit 8 is discharged to any of the trays 12 as described is referred to as the third path. Although not illustrated in FIG. 1, at a position that is located downstream of the drying unit 8 and serves as a branching position, a movable flapper for selectively guiding a sheet to any of the second and third paths is provided.

The control unit 13 is a unit that controls the whole of the printing apparatus. The control unit 13 is, in addition to a controller provided with a CPU, storage devices, and various control parts, and an external interface, provided with a control part 15 through which a user performs input/output. Operation of the whole of the printing apparatus is controlled on the basis of a command from the controller or a host device 16 connected to the controller through the external interface, such as a host computer.

Figure 2:
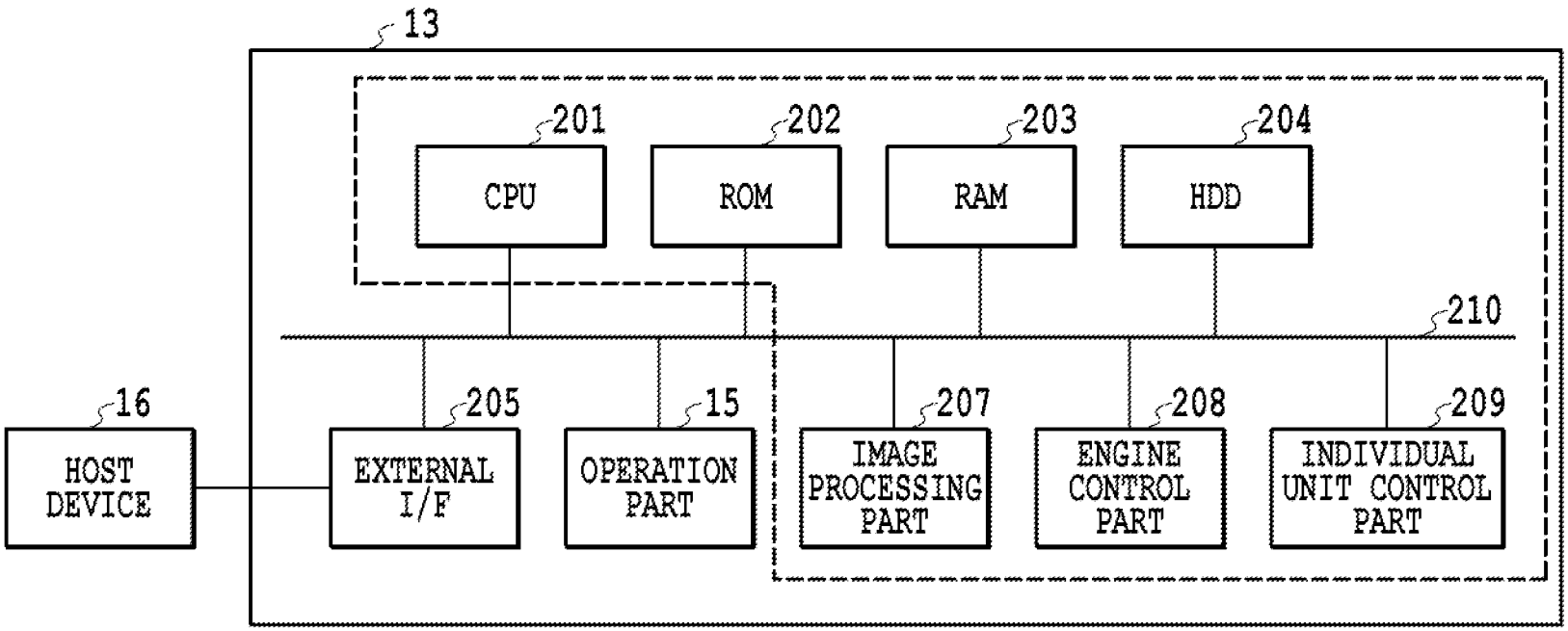
FIG. 2 is a block diagram for describing a configuration of control in a control unit.

FIG. 2 is a block diagram for describing a configuration of the control in the control unit 13. An area surrounded by a dashed line corresponds to the controller, which is configured to include the CPU 201, ROM 202, RAM 203, HDD 204, image processing part 207, engine control part 208, and individual unit control part 209. The CPU 201 (central processing unit) integrally controls operations of the respective units as described above, and according to image data received from the host device 16 connected to the outside, performs a print operation. The ROM 202 stores a program to be executed by the CPU 201, and pieces of fixed data necessary for various types of operations. The RAM 203 is used as a work area for the CPU 201, or used as a temporary storage area for various pieces of received data. The HDD 204 (hard disk) stores a program to be executed by the CPU 201, image data, and pieces of setting information necessary for various types of operations of the printing apparatus, from which the CPU 201 reads various types of data to perform various types of control. The operation part 15 is an input/output interface with a user, and provided with: input parts such as hard keys and a touch panel; and output parts such as a display and sound generator for presenting pieces of information.

Figure 3A:
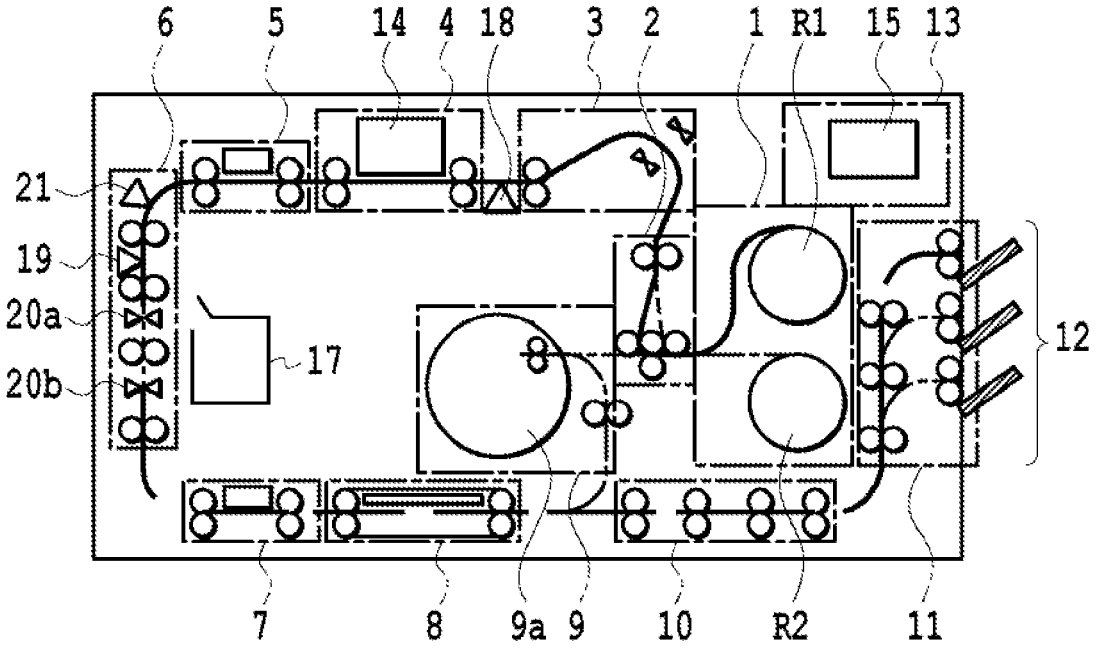
FIGS. 3A and 3B are diagrams for describing simplex and duplex printing operations in detail, respectively.
Figure 3B:
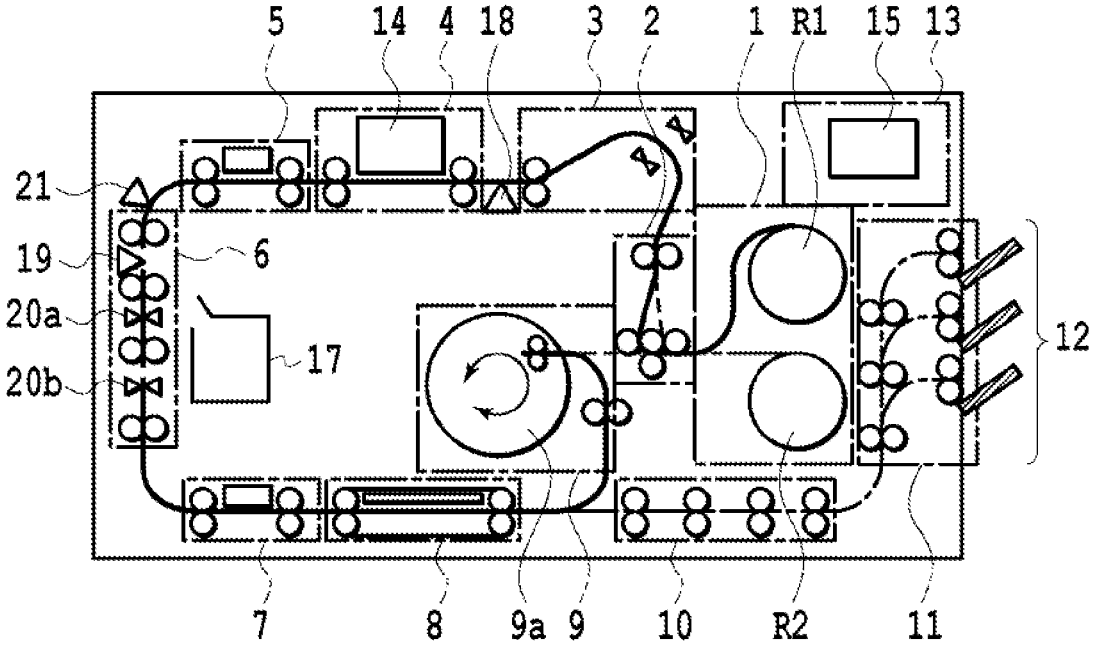

FIGS. 3A and 3B are diagrams for describing respective operations of simplex printing and duplex printing in detail. In both of the diagrams, continuous sheets or cut sheets are indicated by solid lines in conveyance paths, respectively.

Referring to FIG. 3A, in the case of the simplex printing, a continuous sheet fed from the sheet feeding unit 1 passes through the decurling unit 2 and the skewing correcting unit 3, and in the printing unit 4, is printed with a plurality of images (pages) according to pieces of image data. At this time, between images, i.e., between respective pages, a non-image area having a fixed size is provided, and in the non-image area, a cut mark is printed. The printed sheet is cut on a page basis with the two cutters 20*a* and 20*b* arrayed in the cutter unit 6, and the non-image area is contained in the trash box 17. On the other hand, although drawn from the sheet feeding unit, an area not printed in the printing unit 4 is again rewound around the roll R1 or R2 of the sheet feeding unit 1 after cutting for a last page has been completed.

A cut sheet after the cutting is, on a back surface thereof, printed with print information in the information printing unit 7 as needed, and after having been dried in the drying unit 8, placed on a predetermined discharge tray 12 through the discharging/conveying unit 10 and sorter unit 11. As described, in the case of the simplex printing, the sheet is conveyed through the first and third paths, and thereby sequentially subjected to printing, cutting, and discharging operations without delay.

On the other hand, referring to FIG. 3B, in the case of the duplex printing, a continuous sheet fed from the sheet feeding unit 1 passes through the decurling unit 2 and the skewing correcting unit 3, and in the printing unit 4, first, on a first surface (front surface) thereof, is printed with a plurality of images (pages) according to pieces of image data. At this time, between images, i.e., between respective pages, as in the case of the simplex printing, a non-image area having a fixed size is provided, in which a cut mark is also printed.

The printed sheet passes through the cutter unit 6. At this time, the page-based cutting is not performed; however, the cut mark is detected by the cut mark sensor 19, and information on an error in sheet conveyance (an error in conveyance amount and a correction factor) is obtained. Further, only a rear end part of a last page is cut with the cutter 20*b*, and although drawn from the sheet feeding unit, an area not printed is again rewound around the roll R1 or R2 of the sheet feeding unit 1.

On the other hand, a fore end of the continuous sheet is dried in the drying unit 8, and then travels toward the reversing unit 9 in the third path. In the reversing unit 9, the rotary body (drum) 9*a* rotates anticlockwise in the diagram, and rewinds the continuous sheet having been subjected to the first surface printing. The rotary body (drum) 9*a* once stops when having rewound the continuous sheet to a rear end of the continuous sheet, and after it has been confirmed that the sheet located downstream of a cutting position has been sent back and contained again in the sheet feeding unit 1, starts to rotate clockwise. This causes the continuous sheet to be conveyed to the decurling unit 2 with a rear end part of the continuous sheet serving as a fore end part.

In the decurling unit 2 and subsequent units, the continuous sheet is again conveyed through the first path with being reversed in terms of the front and back surfaces and fore and rear ends thereof. In the printing unit 4, in accordance with reference marks on the first surface, which have been read by the mark reader 18, images according to pieces of image data are printed on the second surface. At this time, in a non-image area between images, a cut mark is also printed. The printed sheet is cut on a page basis with the two cutters 20*a* and 20*b* arrayed in the cutter unit 6, and the non-image area is contained in the trash box 17. A cut sheet after the cutting is dried in the drying unit 8, and then placed on a predetermined discharge tray 12 through the discharging/conveying unit 10 and sorter unit 11.

As described, in the case of the duplex printing, the sheet is conveyed in the order of first path→second path →first path→third path, and thereby the first surface (front surface) printing, sheet reversal, second surface (back surface) printing, cutting, and discharging are performed in this order.

Figure 4A:
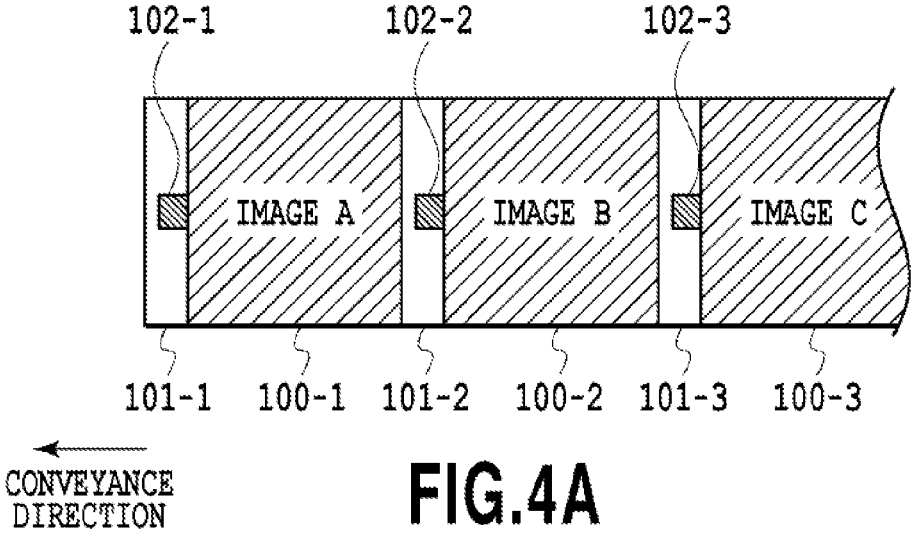
FIGS. 4A to 4C are diagrams illustrating print states of pluralities of images on continuous sheets, respectively.
Figure 4B:
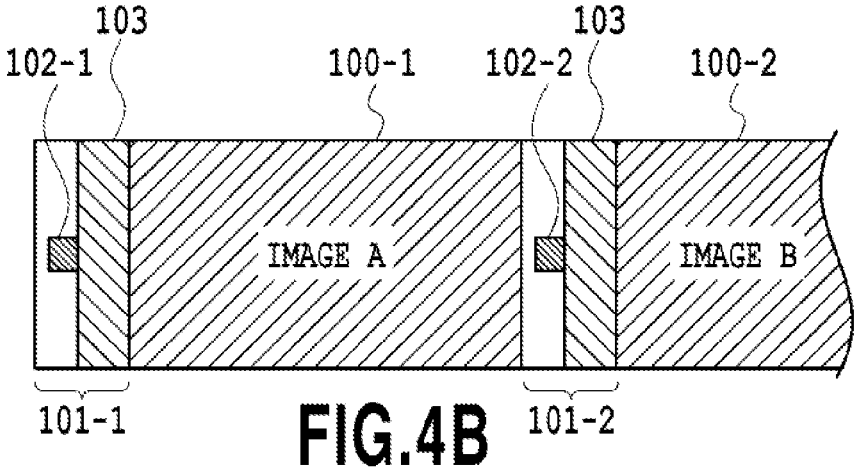
Figure 4C:
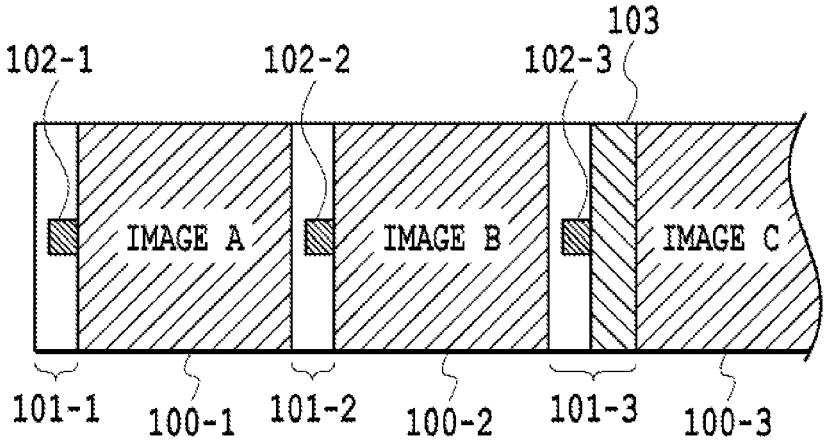

FIGS. 4A to 4C are schematic diagrams for describing print states of pluralities of images (pages) on continuous sheets, respectively. Each of the diagrams illustrates a situation where respective pages are printed on the continuous sheet in the order of images A, B, and C, and the continuous sheet is conveyed in a direction indicated by an arrow.

As in FIG. 4A, immediately before an image area 100-1 of the image A, an image area 100-2 of the image B, and an image area 100-3 of the image C in the conveyance direction, non-image areas 101-1, 101-2, and 1011-3 having the same width are respectively arranged. That is, the printing is performed so as to alternately arrange an image area and a non-image area in the conveyance direction. Also, in the non-image areas 101-1, 101-2, and 101-3, cut marks 102-1, 102-2, and 102-3 are respectively printed by the print head 14.

FIG. 4B illustrates an example where a size of each image is larger than that in the case of FIG. 4A, and a maintenance pattern 103 for detecting non-ejection of the print head is printed in a part of a non-image area (101-1, 101-2, 101-3) every time one page is printed. Also, FIG. 4C illustrates an example where although a size of each image is the same as that in the case of FIG. 4A, in a part of a non-image area 101-3 appearing every few pages, a maintenance pattern 103 is printed. In this case, a length of the non-image area 101-3 in the conveyance direction is larger than those of other non-image areas 101-1 and 101-2 correspondingly to the inclusion of the maintenance pattern 103.

As described, the cut mark is printed in each non-image area without exception; however, the maintenance pattern is only required to be printed in any of non-image areas at as-needed intervals. In addition, in each of FIGS. 4A to 4C, sizes of continuously printed images are the same; however, a size of an image, i.e., a size of an image area may be different on a page basis.

Figure 5A:
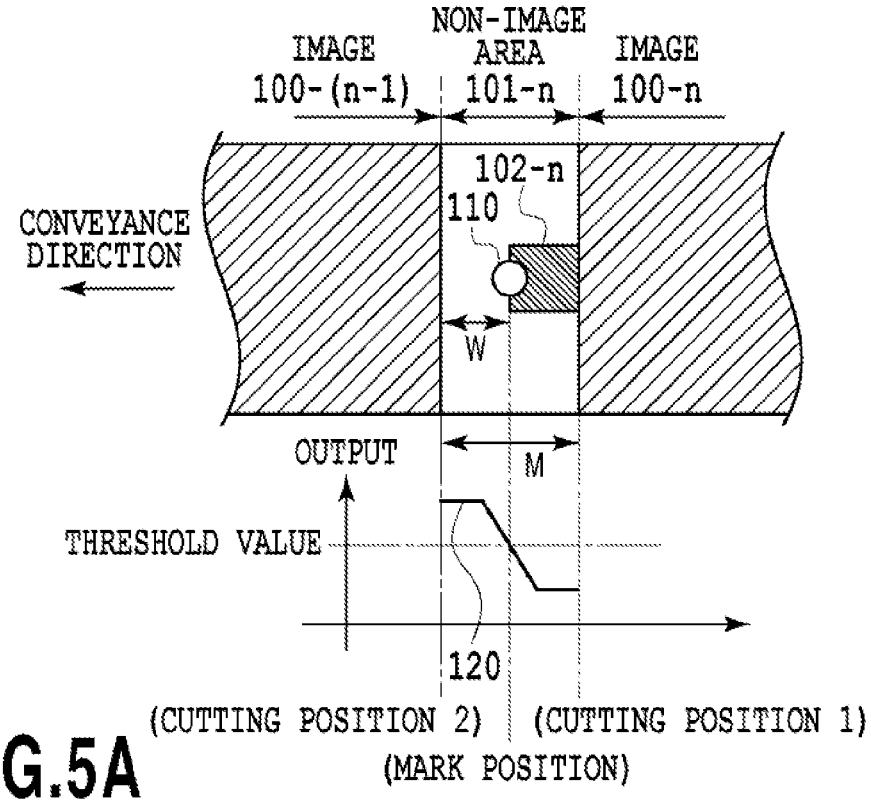
FIGS. 5A and 5B are diagrams illustrating situations where cut marks are detected, respectively.
Figure 5B:
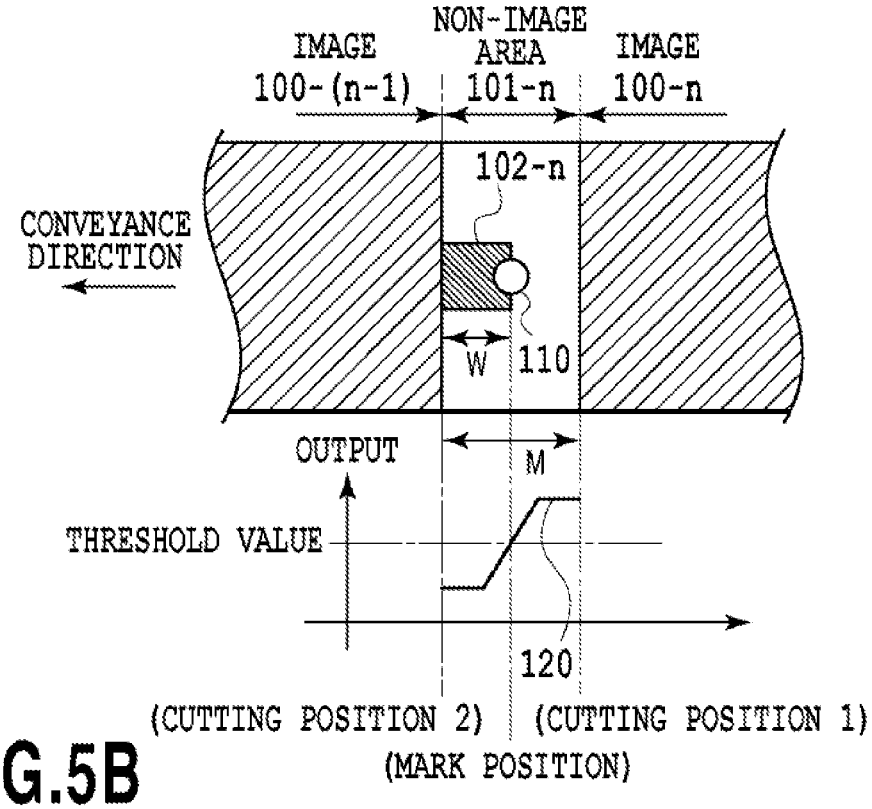

FIGS. 5A and 5B are diagrams each illustrating a situation where a cut mark 102 printed in a non-image area is detected by the cut mark sensor 19 in the cutting unit 6. The cut mark sensor 19 is a small-sized optical sensor having a light source and a light receiver, and irradiates a spot beam having a predetermined size on a sheet from the light source to detect the intensity of reflected beam from the sheet by the light receiver. As the light source, a small-sized semiconductor light source (LED, OLED, semiconductor laser, or the like) is effective. In the case where the beam from the light source is irradiated in a blank area of a sheet, most of the beam is reflected to increase a detected value of the light receiver. On the other hand, in the case where the beam from the light source is irradiated in an area printed with black on a sheet, most of the beam is absorbed to decrease the detected value of the light receiver. Accordingly, a size and color of the cut mark is preferably adjusted depending on a color of the light source and/or a size of a detection area 110 of the light receiver. For example, in the case where the light source is a red LED, the cut mark can be configured as a pattern printed with use of black ink having a high light absorption distribution characteristic with respect to red color. Also, the cut mark preferably has a size enough to include the detection area 110 of the cut mark sensor.

Note that the cut mark may not be necessarily printed by the print head 14 in the printing unit 4. For example, the present invention may provide a dedicated mark providing unit separately from the print head 14, or may be configured to make a small hole in a sheet. In the latter case, the detected value of the light receiver is decreased at timing when irradiated beam passes the hole, and thereby a location of the cut mark can be determined.

Also, as long as the cut mark is printed in a location where the detection area 110 passes in a non-image area, the location thereof is not particularly specified. FIG. 5A illustrates an example where in a non-image area 101-*n*, in a location from a position distant from a rear end of an image area 100-(*n*−1) by a distance W to a fore end of an image area 101-*n*, a cut mark 102-*n* is printed. In the case where a continuous sheet is conveyed in a direction indicated by an arrow, the detection area 110 of the cut mark sensor 19 moves from left to right in the diagram with respect to the non-image area 101-*n*, and a detected result of the cut mark sensor 19 is as in a graph 120 illustrated in a lower part of FIG. 5A.

Referring to the graph 120, an area from the rear end of the image area 100-(*n*−1) to a fore end of the cut mark 102 is a blank area. Accordingly, reflected beam, i.e., an output value of the sensor is kept high. On the other hand, when the detection area 110 starts to include the cut mark 102-*n*, the output value of the cut mark sensor 19 is gradually decreased. Then, when the detection area 110 is completely included in an area of the cut mark 102-*n*, the output value is stabilized at a lowest value. In this case, by preparing a predetermined threshold value, at the point when the output value of the cut mark sensor 19 becomes lower than the threshold value, it can be determined that the cut mark 102-*n* is detected.

On the other hand, FIG. 5B illustrates an example where in a non-image area 101-*n*, in an area from a rear end of an image area 100-(*n*−1) to a position distant from the rear end by a distance W, a cut mark 102-*n* is printed. Even in such a case, at the point when the output value of the cut mark sensor 19 becomes higher than the threshold value, it can be determined that the cut mark 102-*n* is detected.

As in FIG. 5A or 5B, by providing a first area configured as a blank area and a second area printed with the cut mark 102-*n* distinctively from each other, the location of the cut mark 102-*n* can be accurately detected.

In the present embodiment, the detection of a cut mark 102 by the cut mark sensor 19 is not constantly performed during a printing operation but performed only when the detection area 110 is positioned in a limited area within a non-image area 101. For example, in the case of FIG. 5A, from the point when a central part of the first area in the non-image area 101 is estimated to pass the detection area 110 of the cut mark sensor 19 to the point when it is determined that the cut mark sensor 19 detects the cut mark 102, a detecting operation is performed. Further, the present embodiment is adapted not to perform detection itself at other timing, or not to store a detected result. In doing so, even in the case where a pattern enabling an output result similar to that from the cut mark to be obtained is present in an image area, the pattern can be avoided from being erroneously recognized as the cut mark.

Figure 6A:
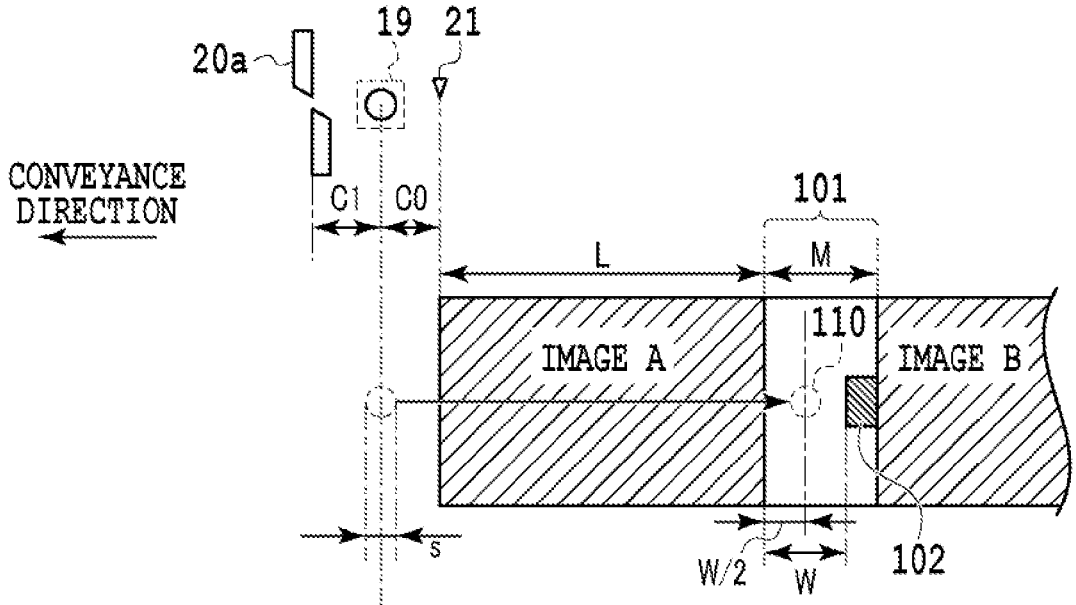
FIGS. 6A to 6C are diagrams for describing a detecting operation of a cut mark sensor in detail.
Figure 6B:
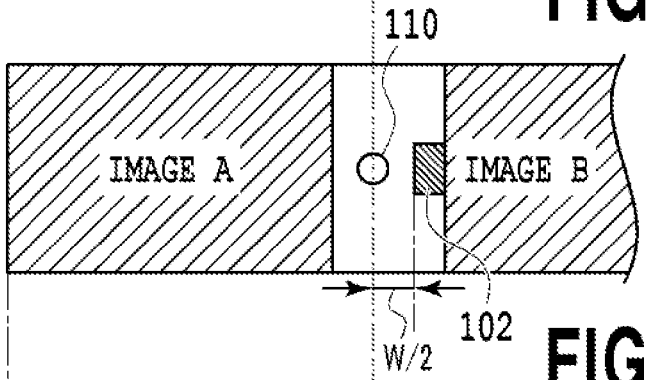
Figure 6C:
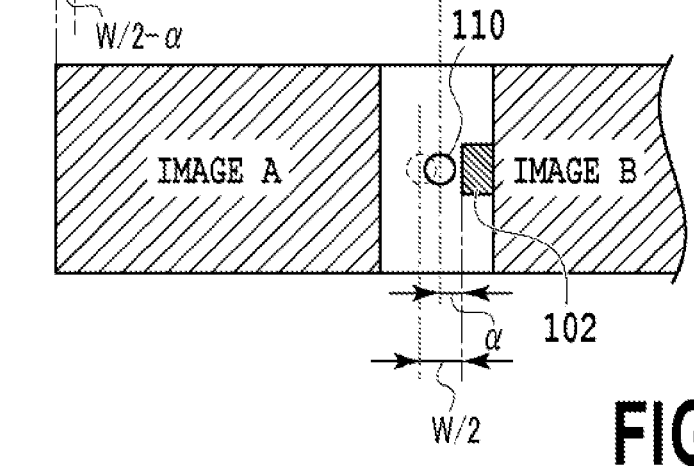

FIGS. 6A to 6C are diagrams for describing control of the detecting operation of the cut mark sensor 19 in more detail. The diagrams illustrate the case where arrangement of a cut mark 102 is the same as that in FIG. 5A, i.e., the cut mark 102 is arranged in a non-image area 101 from a position distant from a rear end of a precedent image A by a distance W to a fore end of a subsequent image B. Also, in the diagrams, in the conveyance direction, a width of the non-image area 101 is denoted by M, a width of a first area from the rear end of the precedent image A to a fore end of the cut mark by W, and a diameter of the detection area 110 of the cut mark sensor by S. Further, a distance between the edge sensor 21 and the cut mark sensor 19 is denoted by C0, a distance between the cut mark sensor 19 and the cutter 20*a* arranged on the upstream side by C1, and a size of the image A by L.

FIG. 6A illustrates the timing when a fore end of a continuous sheet (a fore end part of the image A) has just arrived at the edge sensor 21. When the edge sensor 21 senses the fore end of the continuous sheet, the control unit 13 stops the detecting operation of the cut mark sensor 19, and continues a conveyance operation with keeping a detection stop state.

FIG. 6B illustrates a state where the sheet is conveyed by a distance of (C0+L+W/2) after the edge sensor 21 sensed the sheet fore end, and the detection area 110 of the cut mark sensor 19 has just arrived at the center of the first area. The control unit 13 starts the detecting operation of the cut mark sensor 19 at this timing. The control unit 13 continues the detecting operation until it is determined that the detection area 110 is completely included in an area of the cut mark 102, and the cut mark is detected. In doing so, an output curve as illustrated in FIG. 5A can be obtained to determine a location of the cut mark 102 based on the timing when the output curve exceeds the threshold value.

Figures 7A, 7B, 7C, 7D:
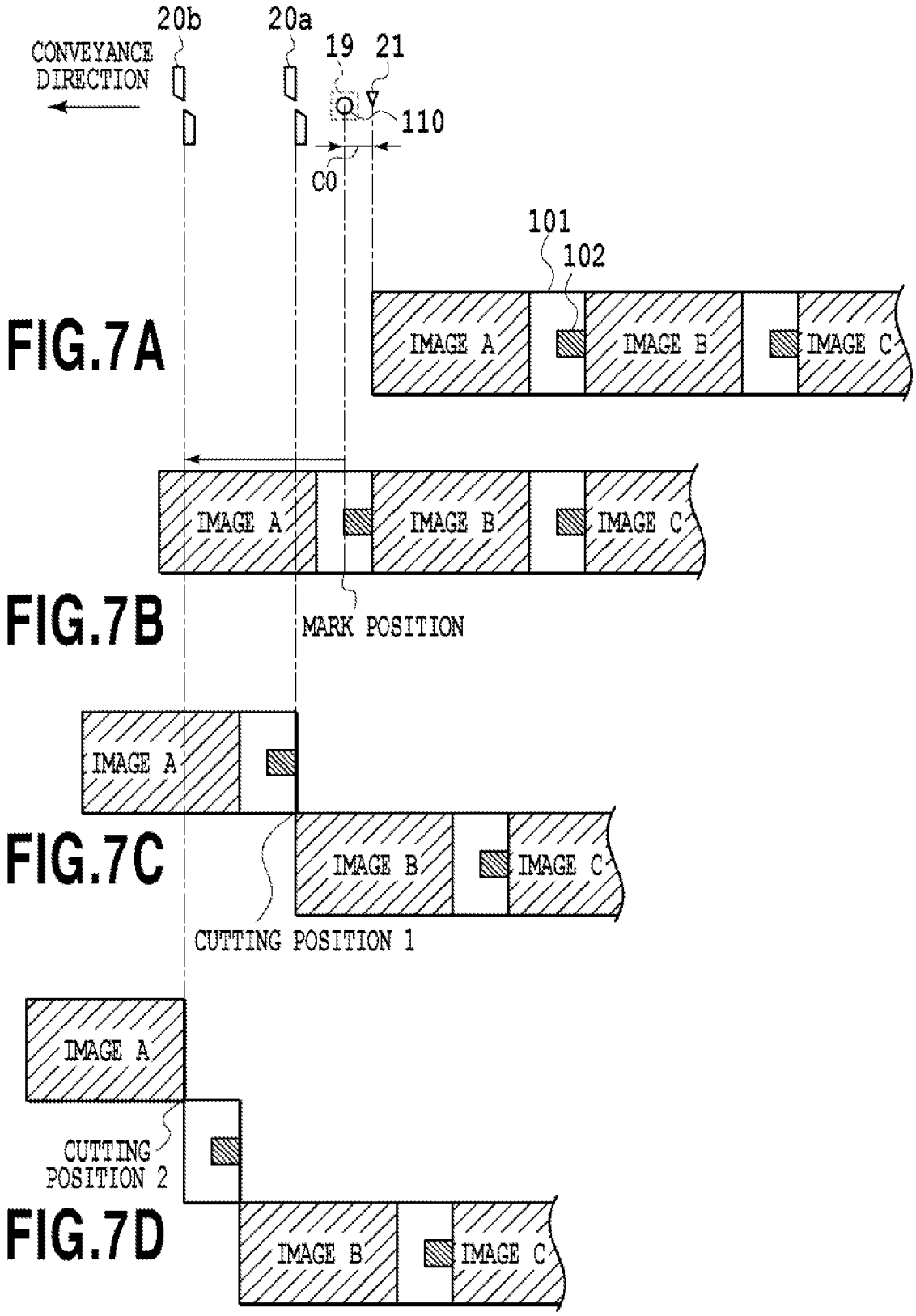
FIGS. 7A to 7D are diagrams illustrating a situation of the detection of a cut mark and a cutting operation.

FIGS. 7A to 7D are diagrams illustrating a situation of the detection of the cut mark 102 and a cutting operation associated with the detection in the cutter unit 6. FIG. 7A illustrates a state where a fore end of a printed continuous sheet has just arrived at the edge sensor 21 of the cutter unit 6. Also, FIG. 7B illustrates a state where a fore end of a first cut mark 102 is positioned at the center of the detection area 110 of the cut mark sensor 19.

With reference to a detection position of the cut mark 102, the control unit 13 uses the two cutters 20*a* and 20*b* to cut fore and rear ends of an image (page). Assuming here that a fore end of an image B corresponds to a cutting position 1, and a rear end of an image A corresponds to a cutting position 2, after the cutter 20*a* arranged on an upper stream side has performed cutting in the cutting position 1, the cutter 20*b* arranged on a lower stream side performs cutting in the cutting position 2. FIG. 7C illustrates a states where the cutting in the cutting position 1 has been performed but the cutting in the cutting position 2 has not yet performed, and FIG. 7D illustrates a state where the cutting in the cutting position 2 has also been performed.

When the cutters 20*a* and 20*b* actually perform cutting, the conveyance operation of the sheet is temporarily stopped. Note that a region where the sheet conveyance is stopped is limited only to the cutter unit 6, and in the respective units on upstream and downstream sides of the cutter unit 6, the conveyance operation is kept. At this time, a sheet conveyed on the downstream side of the cutter unit 6 already forms into a cut sheet, and therefore conveyance control of the whole of the apparatus is not influenced. Further, regarding a continuous sheet on the upstream side of the cutter unit 6, although the sheet is slightly bent near a gate to the cutter unit 6, an amount of the bend is a little, and not enough to influence a printing position in the printing unit 4 as well.

The above-described two-step cutting causes the continuous sheet to be separated into the image area printed with the image according to image data and the non-image area printed with the cut mark and/or a maintenance pattern. Then, the image area is conveyed to the information printing unit 7 as the cut sheet, and the non-image sheet is contained in the trash box 17. After that, the same process as above is also performed on the images B and C subsequent to the image A, and the separation between a cut sheet as an image area and a non-image sheet is repeated.

As described above, in the present embodiment, only in an area assumed to be formed with a cut mark within a non-image area, the detecting operation by the cut mark sensor is enabled. In doing so, a pattern in an image, which enables an output result similar to that from the cut mark to be obtained, can be avoided from being determined as the cut mark to cut the image.

Note that a conveyance amount from when the edge sensor 21 senses the sheet fore end to when the cut mark sensor 19 starts the detecting operation is estimated from a driving amount of a motor through which the control unit 13 rotates the conveyance rollers, and therefore an actual conveyance amount includes an error to no small extent. In the present embodiment, at a position having a margin of W/2 before an area assumed to be printed with a cut mark, the detection of the cut mark is started, and therefore in the case where the error falls within the range, a location of the cut mark is not erroneously determined. However, if the error exceeds the range, the location of the cut mark may be erroneously determined.

FIG. 6C is a diagram illustrating the case where an error occurs in the conveyance amount during a period from when the edge sensor 21 senses the sheet fore end to when the cut mark sensor 19 starts the detecting operation, and a detection start position of the cut mark sensor 19 is displaced from a regular position. In the case where an amount of the displacement is sufficiently smaller than W/2, the cut mark is normally detected.

However, such an error is influenced by environmental temperature or humidity, a sheet material, or the like, and as a size of an image is increased, increases cumulatively. If the displacement amount exceeds W/2, an output from the cut mark sensor does not result in a curved line that is, as illustrated in FIG. 5A, gradually changed from a lower value than the threshold value to a higher value than the threshold value (or a higher value to a lower value). In the case of attempting to set a value of W depending on an assumed error, as in Japanese Patent Laid-Open No. 2012-158122, as an error increases, a non-image area should be set larger, which causes an increase in running cost.

In consideration of the above situation, in the present embodiment, a conveyance error is detected during a first surface printing operation in duplex printing, which is not accompanied by the cutting operation, and in a second surface printing operation accompanied by a cutting process, the cutting process is performed based on a conveyance amount being corrected depending on the obtained conveyance error. In the following, a process for obtaining information on a sheet conveyance error (a conveyance error and a correction factor), which is performed during the first surface printing operation, is described in detail.

Figure 8:
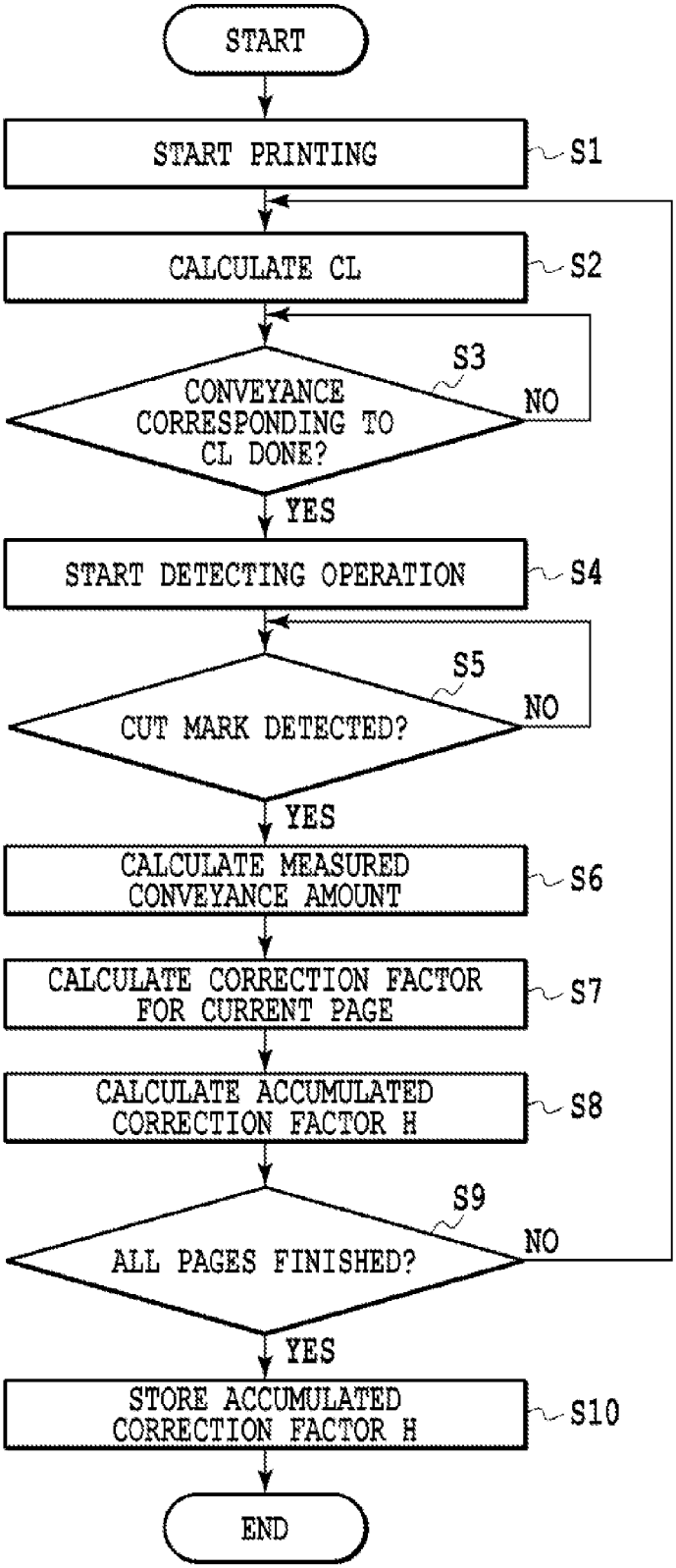
FIG. 8 is a flowchart illustrating a process for obtaining a correction factor at the time of first surface printing.

FIG. 8 is a flowchart for describing the process for obtaining the correction factor, which is performed by the control unit 13 during the first surface printing. After the process has been started, first, in Step S1, the control unit 13 starts the first surface printing operation. That is, a sheet is drawn from the sheet feeding unit 1 and conveyed, and in the printing unit 4, predetermined images are printed on a page basis. At this time, between pages, a non-image area having a fixed width M is provided, in which a cut mark is printed. At the timing when the printing operation is started, the detecting operation of the cut mark sensor 19 is stopped. Also, at the timing when the printing operation is started, the control unit 13 starts to count a driving amount of the conveyance motor.

In Step S2, the control unit 13 calculates a theoretical conveyance amount from the timing when the cut mark sensor 19 detects a cut mark for a precedent image to when the detecting operation of the cut mark sensor 19 is started next. In the case where a size of a target image in the conveyance direction is L, the theoretical conveyance amount CL is CL=L+W/2. Note that in the case where the target image is a forefront image, the theoretical conveyance amount CL from the timing when the edge sensor 21 detects a fore end of the sheet to when the detecting operation of the cut mark sensor 19 is started next is calculated as CL=L+W/2+C0.

In Step S3, the control unit 13 determines whether or not a conveyance operation corresponding to CL has been performed after the timing when the cut mark sensor 19 detected the cut mark for the precedent image (or the timing when the edge sensor 21 detected the fore end of the sheet). Specifically, the control unit 13 determines whether or not a driving amount corresponding to CL has been provided to the conveyance motor after the timing when the cut mark sensor 19 detected the cut mark for the precedent image (or the timing when the edge sensor 21 detected the fore end of the sheet). Until it is determined that the conveyance operation corresponding to CL has been performed, a current conveyance operation is kept.

In the case where in Step S3, it is determined that the conveyance operation corresponding to CL has been performed, the flow proceeds to Step S4, where the detecting operation by the cut mark sensor 19 is started.

In Step S5, it is determined whether or not the cut mark sensor 19 has detected a cut mark. That is, as described with FIG. 5, it is determined whether or not the output value of the cut mark sensor 19 has exceeded the predetermined threshold value. Until the cut mark sensor 19 detects the cut mark, the determination in Step S5 is repeated.

In the case where in Step S5, it is determined that the cut mark has been detected, the flow proceeds to Step S6, where the detecting operation of the cut mark sensor is stopped. Further, a measured conveyance amount $\alpha$ during a period from when the cut mark sensor 19 starts the detecting operation to when the cut mark sensor 19 actually detects the cut mark is measured from a driving amount of the conveyance motor during the period.

In Step S7, the correction factor H is calculated from a theoretical conveyance amount W/2 from when the detecting operation of the cut mark sensor is started to when the cut mark is detected and the measured conveyance amount $\alpha$. In the following, this is described in detail. An error $(W/2-\alpha)$ between the theoretical conveyance amount W/2 from when the detecting operation of the cut mark sensor is started to when the cut mark is actually detected and the measured conveyance amount $\alpha$ occurs during a period when the conveyance operation corresponding to the theoretical conveyance amount CL is performed. That is, actual conveyance gives rise to a displacement R times $(R=(W/2-\alpha)/CL=(W/2-\alpha)/(L+W/2))$ the theoretical conveyance amount. Accordingly, in order to obtain a conveyance amount equal to the theoretical one, it is only necessary to drive the conveyance motor so as to meet a driving amount obtained by multiplying a theoretical driving amount by $(1-R)$. In Step S7, the correction factor $H=(1-R)$ for such a driving amount is calculated from the theoretical conveyance amount W/2 and the measured conveyance amount $\alpha$. That is, the correction factor is $H=(1-R)=(1-(W/2-\alpha)/(L+W/2))$.

Note that, the conveyance error as described above includes a variation after all, and the correction factor calculated for only the one image may lack reliability. For this reason, in the present embodiment, simultaneously with performing conveyance control based on correction factors for up to a precedent page, a conveyance error is further calculated for each of a plurality of pages to accumulate a correction factor.

Figure 9:
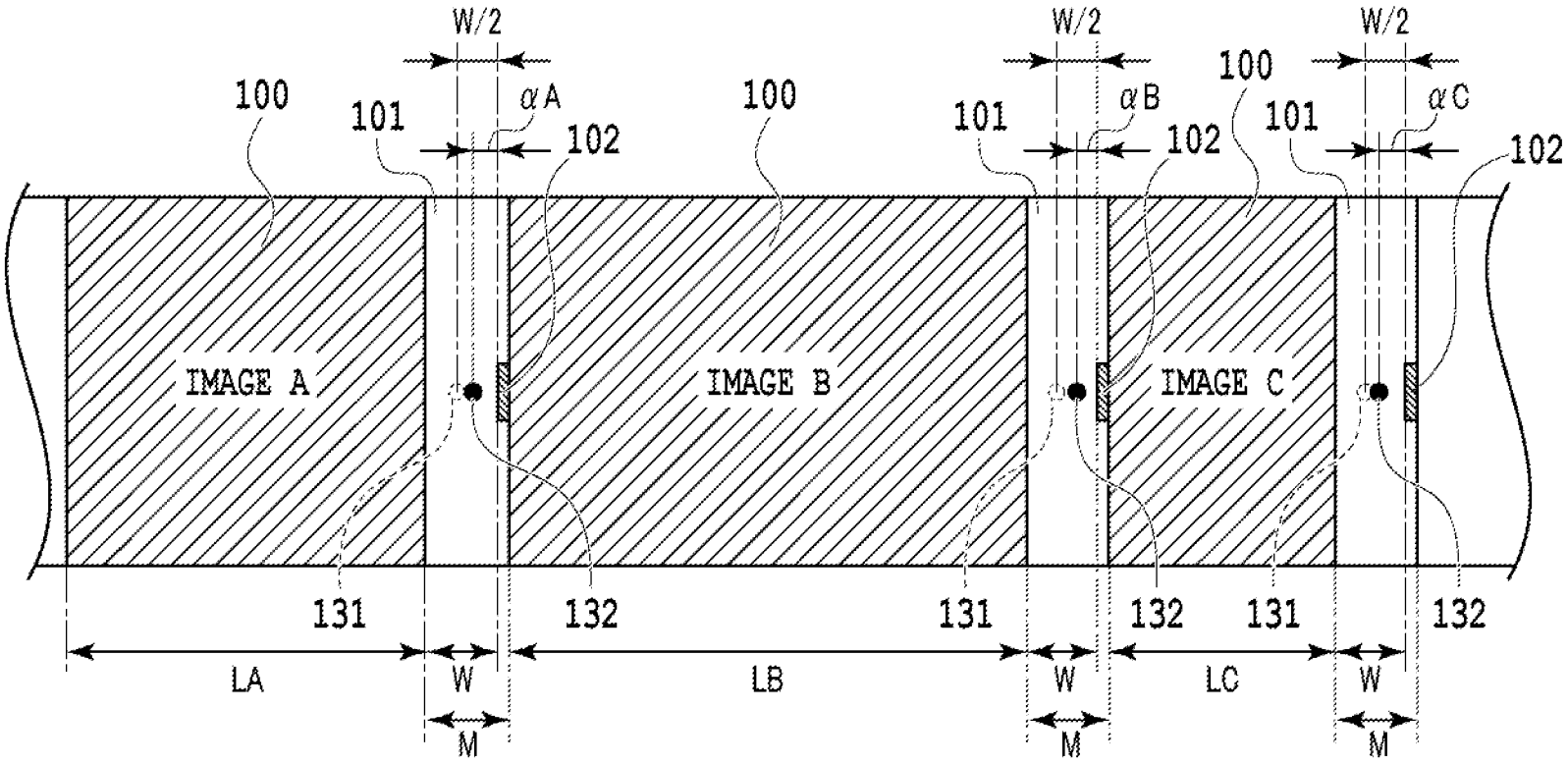
FIG. 9 is a diagram illustrating an example of a plurality of images printed on a continuous sheet.

FIG. 9 is a diagram illustrating an example of a plurality of images printed on a continuous sheet. Sizes of continuously printed three images A, B, and C in the conveyance direction are respectively LA, LB, and LC. On the other hand, sizes of non-image areas 101 provided between the images A and B and between B and C have a fixed value M regardless of an image size. In second areas from positions distant from rear ends of precedent images by W to positions in contact with corresponding subsequent images, cut marks 102 having the same size are printed, respectively.

Assuming here that, regarding the forefront image A, a measured conveyance amount from when the detecting operation of the cut mark sensor 19 is started to when the cut mark is actually detected is $\alpha A$, and a correction factor obtained from $\alpha A$ is HA, from the above-described expression, the following expression holds:

$$HA=(1-(W/2-\alpha A)/(LA+W/2)).$$

Referring to FIG. 8 again, regarding the forefront image A, in Step S8, H is replaced as H=HA, and the flow proceeds to Step S9.

In Step S9, it is determined whether or not printing of all pages (all images) on a first surface and obtainment of correction factors for all the pages have been completed. In the case where the printing of all the pages has not been completed, the flow returns to Step S2 to obtain a conveyance error and a correction factor regarding a subsequent image.

At the time of printing for the image B, in Step S2, CL is calculated according to the correction factor H obtained in Step S8. That is, the size of the image B in the conveyance direction is LB, and therefore a theoretical conveyance amount CL is calculated as $CL=(LB+W/2)\times H$. Further, in Step S3, on the basis of CL obtained in Step S2, the conveyance control is performed, and in Step S4, the detecting operation of the cut mark sensor is started at the point when CL is met.

In such a process performed on the image B, a correction factor HB obtained in S7 includes the correction factor HA obtained by the process performed on the image A. Accordingly, in Step S8 performed on the image B, an accumulated value H of them $(H=HA\times HB)$ is calculated, and in conveyance of the subsequent image C, CL is calculated according to the new correction factor H. After that, as a page number proceeds, in Step S8, a correction factor obtained for each page is accumulated as $H=HA\times HB\times \ldots$, and therefore the correction factor H comes close to a more reliable value. Such accumulation is continued until printing of all the images on the first surface ends. In Step S9, in the case where it is determined that printing of all the pages on the first surface has been completed, the flow proceeds to Step S10, and the above correction factor is stored in a memory. At this time, a correction factor is stored for each set of conditions with being related to the set of conditions such as the type and size of the continuous sheet, environmental temperature, and environmental humidity. This process ends here, and the control unit 13 shifts to a printing operation for a second surface.

At the time of printing the second surface, the control unit 13 controls the conveyance operation according to the correction factor H calculated on the basis of all the pages of the first surface, and cuts the continuous sheet according to cut marks printed in non-image areas. Such a correction factor H is a highly reliable correction factor obtained from results of a plurality of times of conveyance precedently performed on the first surface. That is, the correction factor is one in which, not only the type and width size of the sheet used, but also a set of conveyance conditions such as current temperature and humidity is reflected. Accordingly, even after a larger-sized image has been printed, a cut mark can be accurately detected in a non-image area having the predetermined width, and therefore the image can be cut in an accurate position.

As described, according to the present embodiment, at the time of a first surface printing operation, by accumulating correction factors obtained for a plurality of pages, a more highly reliable correction factor can be obtained. Further, at the time of a second surface printing operation, by controlling the conveyance operation with the highly reliable correction factor, a cut mark can be surely detected by the detecting operation of the cut mark sensor within a limited range. As a result, even in the case where a set of conveyance conditions is variously changed, a non-image area printed with a cut mark can be kept to have the fixed amount to improve cost performance.

Note that the above embodiment is described on the premise that the correction factors H are calculated for all of the plurality of images printed on the first surface; however, the present invention is not limited to such an embodiment. It is only necessary that a correction factor H is only required to be sampled to the extent that a value thereof is stabilized, and may be calculated every few pages or every predetermined conveyance amount.

Also, a position to start the detecting operation of the cut mark sensor in a non-image area may not be necessarily the center of a first area (a position distant from a rear end of a precedent image by a distance of W/2). It is only necessary that the position to start the detecting operation, or a range covered by the detecting operation is appropriately set depending on a size of the detection area of the cut mark sensor.

Also, the above embodiment is described on the basis of a configuration in which fore and rear end part of a non-image area are respectively cut with the different cutters on the basis of one cut mark; however, the cut mark or the cut mark sensor can be specially prepared corresponding to each of the cutters.

Further, in the above, the full line type printing apparatus of the inkjet system is taken as an example to provide the description; however, the present invention is not limited to such a configuration. The printing apparatus may be a serial type one, or as a printing system, various systems such as an electrophotographic system, thermal transfer system, dot impact system, and liquid development system can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-085958, filed Apr. 16, 2013, which is hereby incorporated by reference herein in its entirety.

What is claimed is:

1. A printing method comprising:

performing a first printing so as to alternately arrange first image areas and first non-image area on a first surface of a continuous sheet being conveyed by a conveying unit, wherein a first mark is formed in each of the first non-image areas;

detecting each of the first marks with a sensor unit;

obtaining with a correction factor for the conveying unit regarding a conveyance error at a time of conveying the continuous sheet in the respective first image areas, based on a measured conveyance amount in response to a detection of the respective first marks with the sensor unit and a theoretical conveyance amount;

updating the correction factor by multiplying a previous correction factor by a new correction factor each time the new correction factor is obtained in the respective first image areas;

performing a second printing on a second surface of the continuous sheet, which is a back side of the first surface, while controlling the conveying unit for conveying the continuous sheet based on the correction factor obtained in performing the first printing, so as to alternately arrange second image and second non-image areas on the second surface, wherein a second mark for cutting is formed in each of the second non-image areas; and cutting the continuous sheet with a cutter so as to cut off each of the second image areas in response to detection of the respective second marks formed on the second surface.

2. The printing method according to claim 1, wherein, in a conveyance direction, sizes of the first and the second image areas are not fixed and sizes of the first and the second non-image areas are fixed.

3. The printing method according to claim 1, wherein when performing the first printing, the conveying unit is controlled to convey the continuous sheet based on the correction factor repeatedly updated during the first printing.

4. The printing method according to claim 1, further comprising storing the correction factor according to at least one of conditions including a type and a size of the continuous sheet, environmental temperature, and environmental humidity.

5. A method for obtaining information regarding sheet conveyance, comprising:

performing a first printing so as to alternately arrange image areas and non-image areas on a continuous sheet being conveyed by a conveying unit and forming marks in the respective non-image areas;

detecting each of the marks with a sensor unit;

obtaining a correction factor associated with a conveyance error of the conveying unit for conveying the continuous sheet in the respective first image areas, based on a measured conveyance amount in response to a detection of the respective marks with the sensor unit and a theoretical conveyance amount; and updating the correction factor by multiplying a precious correction factor by a new correction factor each time the new correction factor is obtained in the respective first image areas, wherein the correction factor obtained in the first printing is used for the conveying unit to perform sheet conveyance in a second printing that is performed subsequent to the first printing.

6. A printing apparatus comprising:

a conveying unit configured to convey a continuous sheet;

a printing unit configured to perform a first printing so as to alternately arrange image area and a non-image area on the continuous sheet in conveyance by the conveying unit and form marks in the respective non-image areas and perform a second printing subsequently to the first printing;

a detecting unit configured to detect each of the marks that are formed in the first printing; and a control unit configured to obtain a correction factor for the second printing regarding a conveyance error of the conveying unit for conveying the continuous sheet in the respective image areas in the first printing, based on a measured conveyance amount in response to a detection of the respective marks with the detecting unit and a theoretical conveyance amount, the control unit further configures to update the correction factor by multiplying a previous correction factor by a new correction factor each time the new correction factor is obtained in the respective image areas in the first printing, wherein the correction factor obtained in the first printing is used by the conveying unit to perform sheet conveyance in the second printing.

7. A printing apparatus according to claim 6, wherein the printing unit includes an inkjet type line head to perform line printing.

* * * * *